US009869049B2

(12) United States Patent
Park et al.

(10) Patent No.: US 9,869,049 B2
(45) Date of Patent: Jan. 16, 2018

(54) WASHING MACHINE HAVING LID LOCKER

(71) Applicant: LG Electronics Inc., Seoul (KR)

(72) Inventors: Jin Seok Park, Changwon-si (KR); Ki Chul Cho, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 294 days.

(21) Appl. No.: 14/415,052

(22) PCT Filed: Jul. 19, 2013

(86) PCT No.: PCT/KR2013/006478

§ 371 (c)(1),
(2) Date: Jan. 15, 2015

(87) PCT Pub. No.: WO2014/017783

PCT Pub. Date: Jan. 30, 2014

(65) Prior Publication Data

US 2015/0167225 A1 Jun. 18, 2015

(30) Foreign Application Priority Data

Jul. 23, 2012 (KR) ..... 10-2012-0080105

(51) Int. Cl.
*E05C 1/06* (2006.01)
*D06F 37/28* (2006.01)
(Continued)

(52) U.S. Cl.
CPC ..... *D06F 37/28* (2013.01); *D06F 39/14* (2013.01); *E05B 47/0012* (2013.01);
(Continued)

(58) Field of Classification Search
CPC .. D06F 39/14; A47L 15/4259; A47L 2401/26; Y10S 292/69; E05Y 2900/304
(Continued)

(56) References Cited

U.S. PATENT DOCUMENTS 5,823,017 A * 10/1998 Hapke ..... D06F 37/42 210/146
6,318,138 B1 11/2001 Mathews et al.
(Continued)

FOREIGN PATENT DOCUMENTS

CN 1570253 A 1/2005
CN 101892571 A 11/2010
(Continued)

*Primary Examiner* — Mark Williams
(74) *Attorney, Agent, or Firm* — Dentons US LLP

(57) ABSTRACT

Disclosed is a lid locker of a washing machine including a magnet installed at a lid, a housing installed at a casing, a reed switch installed at the housing and actuated by magnetic force of the magnet when the lid is positioned to be closed, a motor installed at the housing and provided with a rotating shaft, a locking member disposed at the housing to move toward and away from the lid, and a power transmission unit to transfer rotational power of the rotating shaft to the locking member such that an orientation of the rotating shaft is different from a direction of forward and backward movement of the locking member. Thereby, the locking member can be moved back and forth in a simple structure and the housing does not need to excessively extend in the longitudinal direction of the locking member. In addition, the lid locker of the washing machine can be compactly installed.

8 Claims, 4 Drawing Sheets

(51) Int. Cl.
*E05B 47/00* (2006.01)
*E05B 47/02* (2006.01)
*D06F 39/14* (2006.01)

(52) U.S. Cl.
CPC ..... *E05B 47/026* (2013.01); *E05B 2047/002* (2013.01); *E05B 2047/0068* (2013.01); *E05B 2047/0069* (2013.01); *Y10T 292/1021* (2015.04)

(58) Field of Classification Search
USPC ..... 292/144, DIG. 69
See application file for complete search history.

(56) References Cited

U.S. PATENT DOCUMENTS 6,363,755 B1 * 4/2002 Hapke ..... D06F 37/42 210/146
7,251,961 B2 * 8/2007 Hapke ..... D06F 39/14 68/12.26
7,493,783 B2 2/2009 Hapke et al.
2004/0104580 A1 * 6/2004 Spiessl ..... D06F 37/42 292/84
2004/0134239 A1 * 7/2004 Hapke ..... D06F 39/14 68/12.26
2004/0163684 A1 * 8/2004 Hapke ..... A47L 15/4259 134/57 DL
2007/0209411 A1 9/2007 Lim et al.
2011/0279004 A1 * 11/2011 Assmann ..... A47L 15/4259 312/228

FOREIGN PATENT DOCUMENTS

DE 102009024503 B3 9/2010
EP 2261415 A2 12/2010
KR 20-2012-0004174 U 6/2012
WO 2012042554 A1 4/2012

* cited by examiner

WASHING MACHINE HAVING LID LOCKER

This application is a National Stage Entry of International Application No. PCT/KR2013/006478 filed Jul. 19, 2013, which claims priority to Korean Patent Application No. 10-2012-0080105, filed on Jul. 23, 2012, each of which are hereby incorporated by reference for all purposes as if fully set forth herein in their entireties.

TECHNICAL FIELD

The present invention relates to a lid locker of a washing machine, and more particularly to a lid locker of a washing machine which locks the lid to open and close the laundry introduction inlet.

BACKGROUND ART

In general, a washing machine is an apparatus that treats laundry through the processes of washing, rinsing and drying to remove contaminants from the laundry such as clothes and bedclothes using washing water such as water containing dissolved detergent or clean water.

The washing machine may include a casing provided with a laundry introduction inlet and forming an external appearance of the washing machine, a washing tub disposed in the casing, a driving mechanism to rotate the washing tub, and a lid functioning as a door to open and close the laundry introduction inlet.

A lid locker to lock the lid or release locking of the lid may be installed at the casing. The lid locker may include a locking member to be engaged with the lid to practically lock the lid and a locking member driving mechanism to operate the locking member.

Meanwhile, the washing machine may include a reed switch to sense opening or closing of the lid. The reed switch is a type of proximity switch. When a magnet approaches the reed switch, the two reeds of the switch contact each other. When the magnet is moved away from the switch, the two reeds are elastically returned and thus separated from each other. The reed switch may be installed together with the locking member and locking member driving mechanism to configure the lid locker.

PRIOR ART DOCUMENT

Patent Document

Korean Patent Application Publication No. 10-2009-0126456 (Dec. 9, 2009)

DISCLOSURE

Technical Problem

A lid locker of a washing machine according to the conventional art includes a solenoid device to suction a plunger and a locker connected to the plunger to move back and forth in a longitudinal direction of the plunger. Thereby, the lid locker of the washing machine is long in length in the longitudinal direction of the plunger. In addition, due to installation of a spring to elastically support the plunger or a shock absorbing means to absorb shock to the spring, the structure of the lid locker is complex.

Technical Solution

In accordance with an aspect of the present invention, the above and other objects can be accomplished by the provision of a lid locker of a washing machine including a magnet installed at a lid, a housing installed at a casing, a reed switch installed at the housing and actuated by magnetic force of the magnet when the lid is positioned to be closed, a motor installed at the housing and provided with a rotating shaft, a locking member disposed at the housing to move toward and away from the lid, and a power transmission unit to transfer rotational power of the rotating shaft to the locking member such that an orientation of the rotating shaft is different from a direction of forward and backward movement of the locking member.

The locking member may move forward and backward on an upper side of the motor.

The power transmission unit may include a driving gear installed on the rotating shaft, a driven gear engaged with the driving gear to rotate and provided with a pinion, and a rack formed at the locking member to extend in a longitudinal direction of the locking member and engaged with the pinion.

The orientation of the rotating shaft may be nonparallel with the direction of forward and backward movement of the locking member.

The reed switch may be positioned at a lower side of a path of movement of the locking member.

The reed switch may be installed at a position higher than a position at which the rotating shaft is disposed.

The reed switch may be disposed to extend in a direction parallel to the rotating shaft.

The lid locker may further include a position detection mechanism operatively connected with the locking member to detect positions at which the locking member is placed when moved forward and backward.

The locking member may include an engagement portion positioned at an upper side of the reed switch, and a position detection mechanism manipulation portion positioned between the position detection mechanism and the motor.

The position detection mechanism manipulation portion may be formed to protrude from the engagement portion in a stepped manner.

The housing may include a first body, the motor being installed at the first body, and a second body inserted into the first body and provided with an accommodation portion to accommodate the reed switch, wherein one of four lateral faces of the accommodation portion including front, back, left and right faces may be open.

Advantageous Effects

When a solenoid device having a plunger of the present invention is used, a simpler structure can be realized to move a locking member back and forth, and excessive elongation of a housing in a longitudinal direction of the locking member is not needed. In addition, the lid locker of the washing machine can be compactly installed.

DESCRIPTION OF DRAWINGS

The above and other objects, features and other advantages of the present invention will be more clearly understood from the following detailed description taken in conjunction with the accompanying drawings, in which.

BEST MODE

Hereinafter, one embodiment of the present invention will be described in detail with reference to the accompanying drawings.

Figure 1:
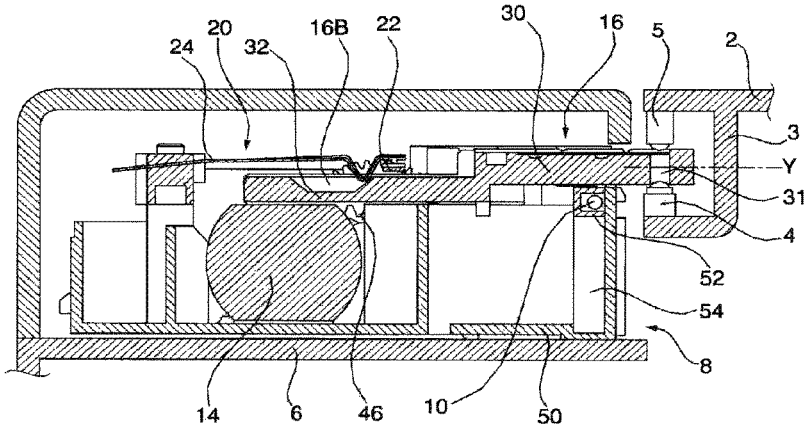
FIG. 1 is a lateral cross-sectional view showing a lid licker of a washing machine in a lid locking mode according to an exemplary embodiment of the present invention.
Figure 2:
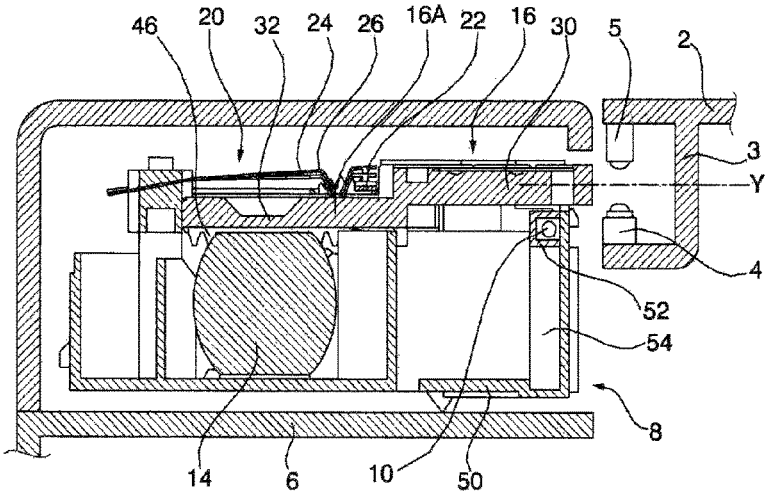
FIG. 2 is a lateral cross-sectional view showing the lid locker of the washing machine in a lid locking release mode according to the illustrated embodiment of the present invention.
Figure 3:
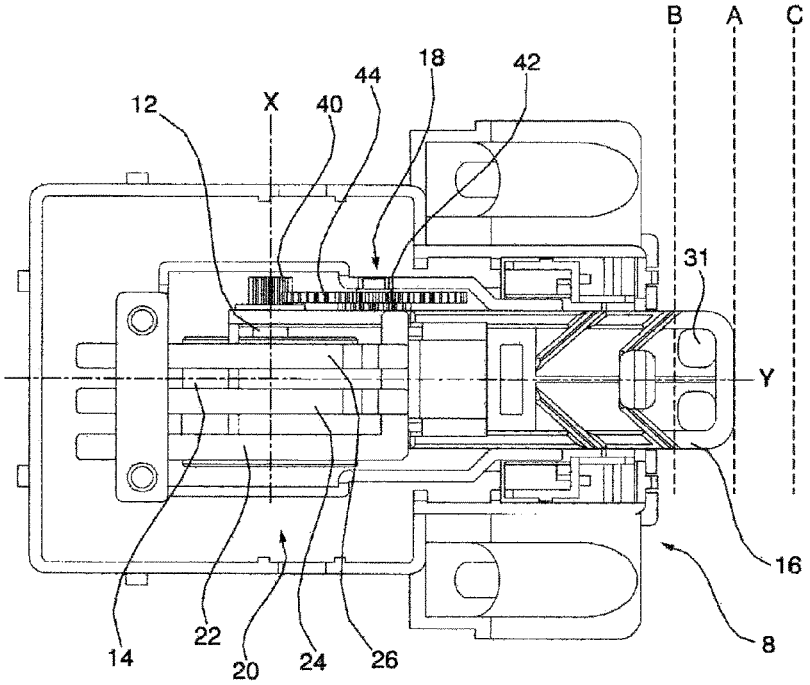
FIG. 3 is a plan view showing the lid locker of the washing machine in the lid locking mode according to the illustrated embodiment of the present invention.
Figure 4:
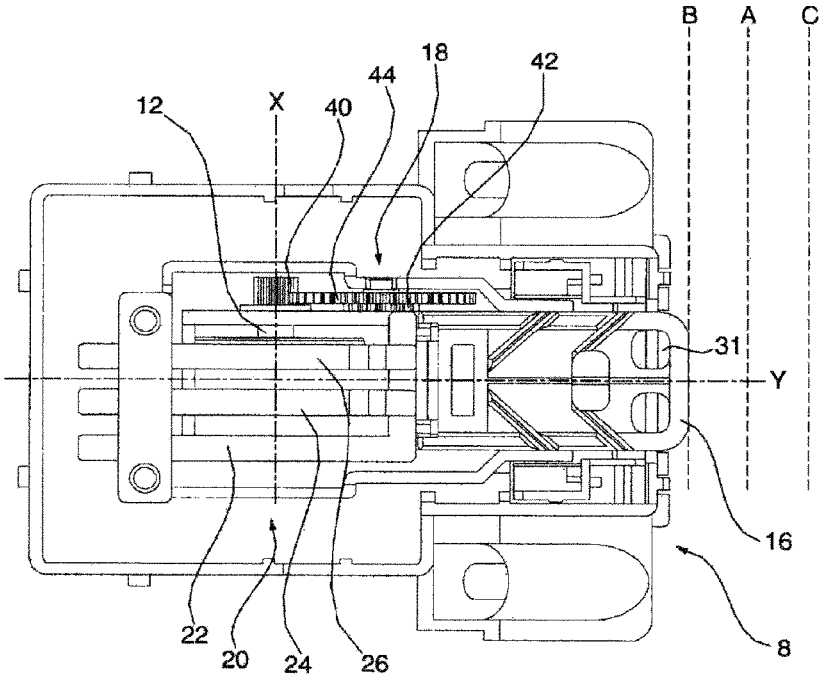
FIG. 4 is a plan view showing the lid locker of the washing machine in the lid locking release mode according to the illustrated embodiment of the present invention.
Figure 5:
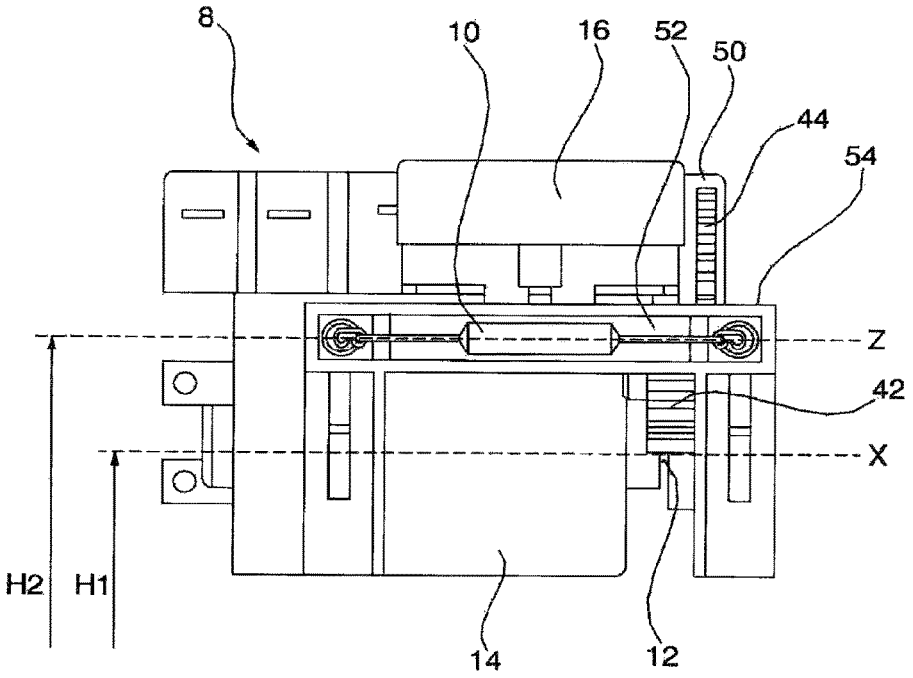
FIG. 5 is a rear view schematically showing the lid locker of the washing machine according to the illustrated embodiment of the present invention.

FIG. 1 is a lateral cross-sectional view showing a lid locker of a washing machine in a lid locking mode according to an exemplary embodiment of the present invention, FIG. 2 is a lateral cross-sectional view showing the lid locker of the washing machine in a lid locking release mode according to the illustrated embodiment of the present invention, FIG. 3 is a plan view showing the lid locker of the washing machine in the lid locking mode according to the illustrated embodiment of the present invention, FIG. 4 is a plan view showing the lid locker of the washing machine in the lid locking release mode according to the illustrated embodiment of the present invention, and FIG. 5 is a rear view schematically showing the lid locker of the washing machine according to the illustrated embodiment of the present invention.

The lid locker of the washing machine according to the illustrated embodiment includes a magnet 4 installed at a lid 2, a housing 8 installed at a casing 6, a reed switch 10 installed at the housing 8 and actuated by magnetic force of the magnet 4 when the lid 2 is at a closed position, a motor 14 installed at the housing 8 and provided with a rotating shaft 12, a locking member 16 disposed at the housing 8 to move toward or away from the lid 2, and a power transmission unit 18 to transfer rotational power of the rotating shaft 12 to the locking member 16 such that the orientation X of the rotating shaft 12 is different from the forward and backward movement direction Y of the locking member 16.

The lid 2 may be installed at the casing 6 to open and close the laundry introduction inlet formed in the casing 6. The lid 2 may be provided with a magnet installation portion 3 in which the magnet 4 is installed. The lid 2 may be integrally provided with a locking member catching portion into which a portion of the locking member 16 is inserted and caught. A hook 5 may be separately installed at the lid 2, and a portion of the locking member 16 may be inserted into and caught by the hook 5.

The casing 6 may form the external appearance of the washing machine, and the laundry introduction inlet is vertically open at the upper portion of the casing 6. The casing 6 may be formed by joining a plurality of members together to form the external appearance of the washing machine. The casing 6 may include a base, a cabinet installed at the upper side of the base, a top cover installed at the upper portion of the cabinet and provided with the laundry introduction inlet. The casing 6 may further include a control panel installed at the top cover to manipulate the washing machine.

The housing 8 may be installed at the casing 6 such that the position thereof is fixed. A space to accommodate the motor 14 may be formed in the housing 8. The housing 8 may be installed at the top cover or between the top cover and the control panel. The housing 8 will be described later.

The lid locker of the washing machine may have a locking mode in which the locking member 16 disposed at the housing 8 is moved forward to position A to protrude toward the lid 2 and engaged with the lid 2, and a locking release mode in which the locking member 16 caught by the lid 2 is moved to position B in a direction opposite to the movement thereof in the locking mode and is thus released from the lid 2.

The washing machine may encounter a situation in which the laundry is, for example, caught between the lid 2 and the casing 6, and thereby the lid 2 fails to completely close the laundry introduction inlet, and may be operated by the user in this situation. With the lid 2 incompletely closing the laundry introduction inlet, the locking member 16 may be further moved to position C (hereinafter, malfunction position), protruding further than in the locking mode. In the case that the washing machine is operated with the locking member 16 disposed at the malfunction position, part of the washing water in the washing machine may leak through the space between the casing 6 and the lid 2. Preferably, when the malfunction position of the locking member 16 is detected, operation of the washing machine is stopped and the situation is reported to the user through an alarm mechanism such as a display or a buzzer. The lid locker of the washing machine may include a position detection mechanism 20 to detect the positions at which the locking member 16 is placed by moving forward and backward.

The position detection mechanism 20 may detect the current position of the locking member 16. The washing machine may be operated or stopped depending on the result of the detection by the position detection mechanism 20. When the locking member 16 moves forward or backward, the position detection mechanism 20 may be operatively connected with the locking member 16 to detect the current position of the locking member 16. The position detection mechanism 20 may be installed such that a portion of the position detection mechanism 20 is positioned at the upper side of the motor 14. When the position detection mechanism 20 is positioned next to the motor 14 or the locking member 16, the total area of the lid locker of the washing machine may increase. Preferably, a portion of the position detection mechanism 20 is positioned at the upper side of the motor 14. The position detection mechanism 20 may include a fixed terminal 22, and a plurality of the movable terminals 24 and 26 to selectively contact the fixed terminal 22. One side of each of the fixed terminal 22 and the movable terminals 24 and 26 may be fixed to the housing 8. The other side of each of the movable terminals 24 and 26 may be a free end. When the locking member 16 is at the position A and is thus engaged with the lid 2, the movable terminal 24 of the movable terminals 24 and 26 of the position detection mechanism 20 may contact the fixed terminal 22. When the locking member 16 is at the position B and is thus not engaged with the lid 2, the movable terminal 26 of the movable terminals 24 and 26 of the position detection mechanism 20 may contact the fixed terminal 22. When the locking member 16 is at position C, i.e., the malfunction position, the movable terminals 24 and 26 of the position detection mechanism 20 may both contact the fixed terminal 22, or none of the movable terminals 24 and 26 may contact the fixed terminal 22. When external force is not applied to the movable terminals 24 and 26, the movable terminals 24 and 26 may be disposed to be in contact with the fixed terminal 22. The locking member 16 may include a first guide portion 16A to elastically deform the other one 26 of the movable terminals 24 and 26 such that the other one 26 of the movable terminals 24 and 26 does not contact the fixed terminal 22 when the locking member 16 is placed, for example, at the position A at which the lid 2 is locked by the locking member 16. The locking member 16 may be provided with a second guide portion 16B to elastically deform the movable terminal 24 of the movable terminals 24 and 26 such that the movable terminal 24 of the movable terminals 24 and 26 does not contact the fixed terminal 22 when the locking member 16 is placed, for example, at the position B at which locking of the lid 2 is released.

When the lid 2 is at the laundry introduction inlet-closed position at which the lid 2 closes the laundry introduction inlet, the reed switch 10 may be turned on by magnetic force of the magnet 4. When the lid 2 is at the laundry introduction inlet-open position at which the lid 2 does not close the laundry introduction inlet, the reed switch 10 may be turned off by the elastic resilience of the lid 2. The reed switch 10 may be positioned at the lower side of the path of movement of the locking member 16. The height H1 at which the reed switch 10 is installed may be less than the height of the path along which the locking member 16 moves forward and backward, and greater than the height H2 at which the rotating shaft 12 is disposed. The reed switch 10 and the rotating shaft 12 may respectively be installed to have predetermined heights H1 and H2 from the lower end of the washing machine. The installation height H1 of the reed switch 10 from the lower end of the washing machine may be greater than the installation height H2 of the rotating shaft 12 from the lower end of the washing machine. Preferably, the reed switch 10 is installed at a position at which magnetic force of the magnet 4 affects the reed switch 10 when the lid 2 is closed. Preferably, the reed switch 10 is installed at a position high enough to allow the reed switch 10 to be affected by magnetic force of the magnet 4, without a separate magnetic force guide member. In the case that the reed switch 10 is installed on the path of movement of the locking member 16, the reed switch 10 may interfere with movement of the locking member 16. Accordingly, the reed switch 10 is preferably installed at the upper side or lower side of the path of movement of the locking member 16. In the case that the reed switch 10 is installed at the upper side of the path of movement of the locking member 16, the height of the housing 8 at which the reed switch 10 is installed may be increased. Positioning the reed switch 10 at the lower side of the path of movement of the locking member 16 may prevent excessive increase in height of the housing 8 at which the reed switch 10 is installed and generally realize a compact arrangement. The reed switch 10 may be installed at the housing to extend in a longitudinal direction or lateral direction of the housing 8. The reed switch 10 may be disposed in a direction Z parallel with the rotating shaft 12. With regard to the lid locker of the washing machine, the orientation X of the rotating shaft 12 may not be parallel with the forward and backward movement direction Y of the locking member 16. The orientation X of the rotating shaft 12 may not coincide with the forward and backward movement direction Y of the locking member 16. When the lid locker of the washing machine is viewed from the upper side or lower side thereof, the orientation X of the rotating shaft 12 may be perpendicular to or inclined with respect to the forward and backward movement direction Y of the locking member 16, with a difference in height between the line in the rotating shaft 12 and the locking member 16. The locking member 16 may be arranged at a position higher than the position of the rotating shaft 12 to move forward and backward in a direction perpendicular to the direction of protrusion of the rotating shaft 12. In the case that the rotating shaft 12 of the motor 14 of the lid locker of the washing machine is disposed to extend in a lateral direction, the locking member 16 may move in a front-back direction, and the reed switch 10 may be disposed to extend in the lateral direction as the rotating shaft 12 of the motor 14.

The locking member 16 may be slidably disposed at the housing 8. In this case, the locking member 16 may be moved forward to protrude toward the laundry introduction inlet of the casing 6 or moved backward to the housing 8 from the position to which it has been moved to protrude the laundry introduction inlet of the casing 6. When the lid 2 is at a position at which it closes the laundry introduction inlet of the casing 6, the locking member 16 may be coupled to or separated from the lid 2. The locking member 16 may be disposed at the upper side of the motor 14 to move forward and backward. The locking member 16 may be disposed at the upper side of the reed switch 10 to move forward and backward. The locking member 16 may be disposed to extend in a longitudinal direction from the upper side of the motor 14 to the upper side of the reed switch 10. The locking member 16 may include an engagement portion 30 positioned at the upper side of the reed switch 10, and a position detection mechanism manipulation portion 32 positioned between the position detection mechanism 20 and the motor 14.

The engagement portion 30 is a portion to be engaged with the lid 2 and may be engaged with the locking member catching portion integrally formed at the lid 2, or with the hook 5 separately installed at the lid 2. The engagement portion 30 may be provided with an engagement hole 31 allowing a portion of the locking member catching portion or the hook 5 to be inserted thereinto and caught. The engagement portion 30 may be positioned at the upper side of the reed switch 10, regardless of the position of the locking member 16.

The position detection mechanism manipulation portion 32 may be formed to protrude from the engagement portion 30 in a stepped manner. The position detection mechanism manipulation portion 32 may be moved forward to the position A, at which the position detection mechanism manipulation portion 32 covers a narrow area of the motor 14, and may be moved backward to the position B, at which the position detection mechanism manipulation portion 32 covers a wide area of the motor 14. The first guide portion 16A and the second guide portion 16B may be formed on the upper surface of the position detection mechanism manipulation portion 32 to protrude from the upper surface.

The power transmission unit 18 may include a driving gear 40 installed on the rotating shaft 12, a driven gear 44 engaged with the driving gear 40 to rotate and provided with a pinion 42, and a rack 46 formed at the locking member 16 to extend in the longitudinal direction of the locking member 16 and engaged with the pinion 42. In the case that the power transmission unit 18 is disposed to protrude from the motor 14 in the lateral direction of the rotating shaft 12 of the motor 14, the driving gear 40 may be disposed next to the motor 14, the driven gear 44 may be disposed next to the locking member 16, the pinion 42 may be disposed at the lower side of the locking member 16, and the rack 46 may be formed on the lower surface of the locking member 16 to extend in a direction in which the locking member 16 moves forward and backward.

The housing 8 may include a first body 50 provided with the motor 14, a second body 54 inserted into the first body 50 and provided with an accommodation portion 52 allowing the reed switch 10 to be accommodated therein. One of the four lateral faces of the accommodation portion 52 including the front, back, left and right faces may be open. The reed switch 10 may be inserted into the accommodation portion 52 through the open face and installed. When the second body 54 is inserted into the first body 50 and installed, the open face may be covered by the first body 50, and the reed switch 10 may be protected by the first body 50 and the second body 54.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A washing machine having a lid locker, the lid locker comprising:

a magnet installed at a lid;

a housing installed at a casing;

a reed switch installed at the housing for sensing whether the lid is open or closed, wherein the reed switch is actuated by magnetic force of the magnet when the lid is positioned to be closed;

a motor installed at the housing and provided with a rotating shaft;

a locking member disposed at the housing to move toward and away from the closed lid;

a power transmission unit to transfer rotational power of the rotating shaft to the locking member such that the locking member moves toward and away from the closed lid, wherein the reed switch is installed at a position higher than a position at which the rotating shaft is disposed; and a position detection mechanism operatively connected with the locking member to detect positions at which the locking member is placed when moved forward and backward, wherein the locking member comprises:

an engagement portion positioned at an upper side of the reed switch, wherein the engagement portion engages the closed lid to lock the closed lid; and a position detection mechanism manipulation portion positioned between the position detection mechanism and the motor, and wherein when the lid is positioned to be closed, the locking member moves toward the closed lid to lock the closed lid.

2. The washing machine according to claim 1, wherein the locking member moves forward and backward on an upper side of the motor.

3. The washing machine according to claim 1, wherein the power transmission unit comprises:

a driving gear installed on the rotating shaft;

a driven gear engaged with the driving gear to rotate and provided with a pinion; and a rack formed at the locking member to extend in a longitudinal direction of the locking member and engaged with the pinion.

4. The washing machine according to claim 1, wherein the orientation of the rotating shaft is nonparallel with the direction of forward and backward movement of the locking member.

5. The washing machine according to claim 1, wherein the reed switch is positioned at a lower side of a path of movement of the locking member.

6. The washing machine according to claim 1, wherein the reed switch is disposed to extend in a direction parallel to the rotating shaft.

7. The washing machine according to claim 1, wherein the position detection mechanism manipulation portion is formed to protrude from the engagement portion in a stepped manner.

8. The washing machine according to claim 1, wherein the housing comprises:

a first body, the motor being installed at the first body; and a second body inserted into the first body and provided with an accommodation portion to accommodate the reed switch, wherein one of four lateral faces of the accommodation portion including front, back, left, and right faces is open.

* * * * *